US007059489B2

(12) United States Patent
Apps et al.

(10) Patent No.: US 7,059,489 B2
(45) Date of Patent: Jun. 13, 2006

(54) PORTABLE STORAGE DEVICE

(75) Inventors: William P. Apps, Alpharetta, GA (US); Cynthia R. Aiken, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 202 days.

(21) Appl. No.: 10/269,546

(22) Filed: Oct. 11, 2002

(65) Prior Publication Data

US 2004/0069780 A1 Apr. 15, 2004

(51) Int. Cl.
*B65D 6/18* (2006.01)

(52) U.S. Cl. ..... 220/7; 220/6

(58) Field of Classification Search ..... 220/7, 220/6, 4.28; 206/600
See application file for complete search history.

(56) References Cited

U.S. PATENT DOCUMENTS

| | | | | |
|---|---|---|---|---|
| 1,809,523 | A | | 6/1931 | McLean |
| 2,760,669 | A | | 8/1956 | Kreutzer |
| 3,360,180 | A | | 12/1967 | Venturi |
| 3,446,415 | A | | 5/1969 | Bromley |
| 3,591,212 | A | | 7/1971 | Rhyne |
| 3,853,238 | A | | 12/1974 | Luisada et al. |
| 3,858,745 | A | | 1/1975 | Cloyd |
| 3,874,546 | A | | 4/1975 | Sanders et al. |
| 4,148,407 | A | | 4/1979 | Sinclair |
| 4,591,065 | A | | 5/1986 | Foy |
| 4,887,874 | A | | 12/1989 | Joffe |
| 4,917,255 | A | | 4/1990 | Foy et al. |
| 4,923,079 | A | | 5/1990 | Foy |
| 4,960,223 | A | * | 10/1990 | Chiang et al. ..... 220/7 |
| 5,094,356 | A | | 3/1992 | Miller |
| 5,114,034 | A | * | 5/1992 | Miller et al. ..... 220/7 |
| 5,161,709 | A | | 11/1992 | Oestreich, Jr. |
| 5,330,067 | A | * | 7/1994 | Gronnevik ..... 220/7 |
| 5,332,114 | A | | 7/1994 | Sano et al. |
| 5,398,834 | A | | 3/1995 | Umiker |
| 5,398,835 | A | | 3/1995 | Blinstrub |
| 5,467,885 | A | | 11/1995 | Blinstrub |
| 5,515,987 | A | | 5/1996 | Jacques et al. |
| 5,586,675 | A | | 12/1996 | Borsboom et al. |
| 5,588,549 | A | | 12/1996 | Furtner |
| 5,632,392 | A | | 5/1997 | Oh |
| 5,671,857 | A | | 9/1997 | Stromberg |
| 5,797,508 | A | | 8/1998 | Loftus et al. |
| 5,829,617 | A | | 11/1998 | Umiker |
| 5,853,099 | A | | 12/1998 | Lessard |
| 5,860,527 | A | | 1/1999 | Frankenberg et al. |
| 6,015,056 | A | | 1/2000 | Overholt |
| 6,029,840 | A | | 2/2000 | Brauner |
| 6,073,790 | A | | 6/2000 | Umiker |
| 6,098,827 | A | | 8/2000 | Overholt et al. |
| 6,142,329 | A | | 11/2000 | Dotan |

(Continued)

FOREIGN PATENT DOCUMENTS

| | | |
|---|---|---|
| CA | 2 309 234 A | 11/2000 |

(Continued)

*Primary Examiner*—Stephen Castellano

(57) ABSTRACT

A portable storage device includes the plurality of collapsible walls, each pair of adjacent walls connected by a latch. Each latch can be selectively actuated from both the inside and the outside of the container. Preferably, the latch includes a recess into which the adjacent wall is disposed when the latch is in the latched position. Preferably, the latch is unlatched by flexing the latch away from the adjacent wall by application of force on an inner release surface, inward of the recess or by application of force on an outer release surface, outward of the recess.

22 Claims, 11 Drawing Sheets

U.S. PATENT DOCUMENTS

| | | | |
|---|---|---|---|
| 6,209,742 | B1 | 4/2001 | Overholt et al. |
| D446,392 | S | 8/2001 | Overholt et al. |
| 6,293,418 | B1 | 9/2001 | Ogden et al. |
| D452,614 | S | 1/2002 | Overholt |
| 6,386,388 | B1 | 5/2002 | Overholt |
| D458,753 | S | 6/2002 | Overholt et al. |
| 6,398,054 | B1 | 6/2002 | Overholt et al. |
| 6,405,888 | B1 | 6/2002 | Overholt et al. |
| 6,409,041 | B1 | 6/2002 | Overholt et al. |
| 2002/0108950 | A1 | 8/2002 | Moorman et al. |

FOREIGN PATENT DOCUMENTS

| | | | |
|---|---|---|---|
| DE | 1536040 | | 10/1966 |
| DE | 1296563 | | 5/1969 |
| DE | 2033724 | | 7/1970 |
| DE | 1586980 | | 9/1970 |
| DE | 91 03 975 | | 3/1991 |
| EP | 0 073 357 | | 8/1982 |
| EP | 0 690 003 | | 1/1996 |
| EP | 0 705 764 | A2 | 4/1996 |
| EP | 0 785 142 | | 7/1997 |
| EP | 0 785 142 | A1 | 7/1997 |
| EP | 0 962 394 | A1 | 12/1999 |
| EP | 0 962 396 | | 12/1999 |
| EP | 0 962 396 | A1 | 12/1999 |
| EP | 1 114 779 | | 7/2001 |
| EP | 1 160 169 | A2 | 12/2001 |
| EP | 1 182 139 | A2 | 2/2002 |
| FR | 1040163 | | 10/1953 |
| FR | 2 268 700 | | 11/1975 |
| FR | 2 701 690 | | 2/1993 |
| FR | 2 702 198 | | 3/1993 |
| GB | 1215049 | | 12/1970 |
| GB | 2139189 | | 11/1984 |
| SU | 1533952 | | 1/1990 |
| WO | WO 97/49613 | | 12/1996 |
| WO | WO 00 01586 | | 1/2000 |
| WO | WO 02/06128 | | 1/2002 |
| WO | WO 02/034630 | | 5/2002 |

* cited by examiner

PORTABLE STORAGE DEVICE

BACKGROUND OF THE INVENTION

The present invention relates generally to a portable storage device, and particularly one that collapses.

Portable storage devices that collapse are well known. Four walls each connected by a hinge to a base are selectively movable about the hinge between a use position, in which the wall is generally perpendicular to the base, and a collapsed position. Various mechanisms have been provided to connect adjacent walls at each corner to selectively lock the crate in the use position. Many such storage devices unlatch from outside the container, which is sometimes more efficient for a user, but not usable with automated equipment. Other such storage devices unlatch from the inside, which is often desired for use with automated equipment, but less convenient for human users. Moreover, such storage devices may have hinge mechanisms that are difficult or inefficient to manufacture or clean.

SUMMARY OF THE INVENTION

The present invention provides an improved portable storage device with latch mechanisms selectively connecting adjacent walls at the corners wherein the latches can be actuated from both the inside and from the outside of the crate. Thus, this collapsible crate can be used with automated equipment while still being efficient for a human user.

The collapsible crate according to the present invention generally comprises a base wall and generally perpendicular first and second walls. A latch mechanism is integrally molded with the first wall and connects the first wall to the second wall. The latch mechanism includes a recess into which a portion of the second wall is received, thereby latching the first wall to the second wall. The latch mechanism further includes an outer release surface outward of the second wall and an inner release surface inward of the second wall, thus permitting the latch mechanism to be selectively disconnected from the second wall when the walls are assembled upon application of force to the outer release surface or the inner release surface.

The crate also includes an improved hinge mechanism that is more efficient to manufacture and clean as described herein.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
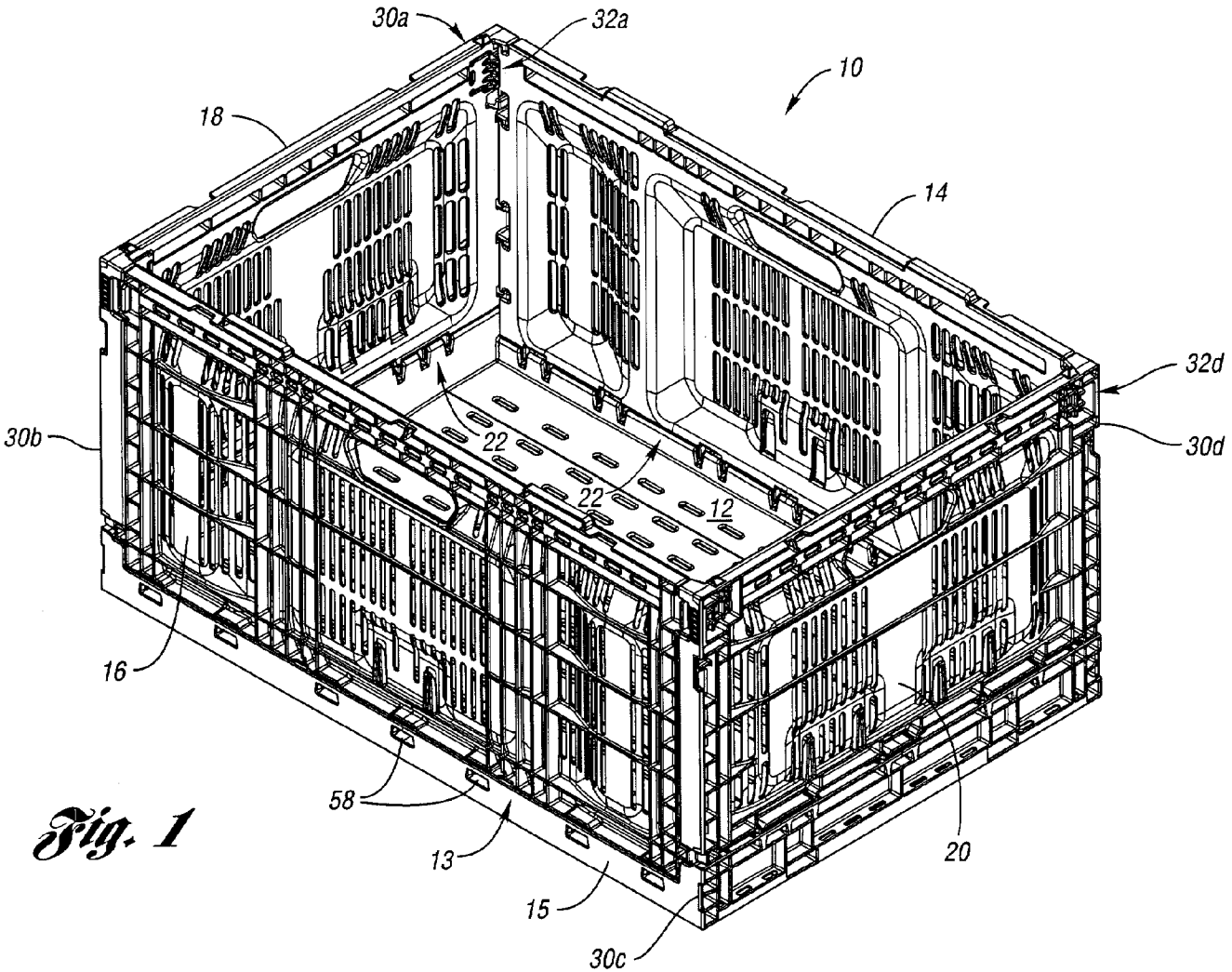
FIG. 1 is a perspective view of the portable storage device shown as a collapsible crate, with the improved latch mechanism and hinge mechanism according to the present invention.
Figure 5:
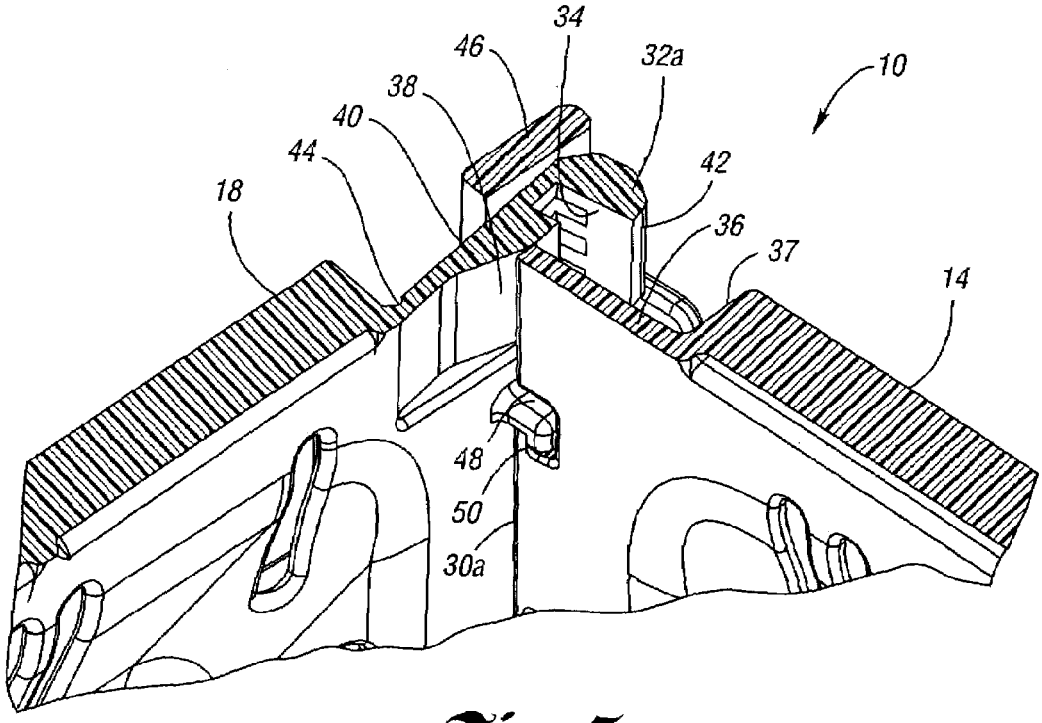
FIG. 5 is a second view, similar to FIG. 4, of the latch in the unlatched position and showing the wall partially collapsed.

A portable storage device 10 according to the present invention is illustrated in FIG. 1. The assembled device 10 is shown as a collapsible crate 10 and includes a base wall 12 and upstanding perpendicular side walls 14, 16 and end walls 18, 20. The side walls 14, 16 are connected to the base wall by hinges 22, 24, respectively. End walls 18, 20 are similarly connected to the base wall via hinges 26, 28, respectively. As is known, the side walls 14, 16 and end walls 18, 20 are collapsible by pivoting at hinge mechanisms 22 onto base wall 12. As shown in FIG. 5, the crate can be collapsed inwardly for shipping or storage and can be quickly set up by pivoting side walls 14, 16 and end walls 18, 20 about their respective hinges 22 to the use position, generally perpendicular to base wall 12. The side walls 14, 16 may then be latched to the adjacent end walls 18, 20 at the corners 30*a*, 30*b*, 30*c*, 30*d* by latches 32*a*, 32*b*, 32*c*, 32*d*, respectively. Because the operation of each of the latches 32*a*–*d* is similar, only the operation of latch 32*a* in corner 30*a* will be described below.

Figure 2:
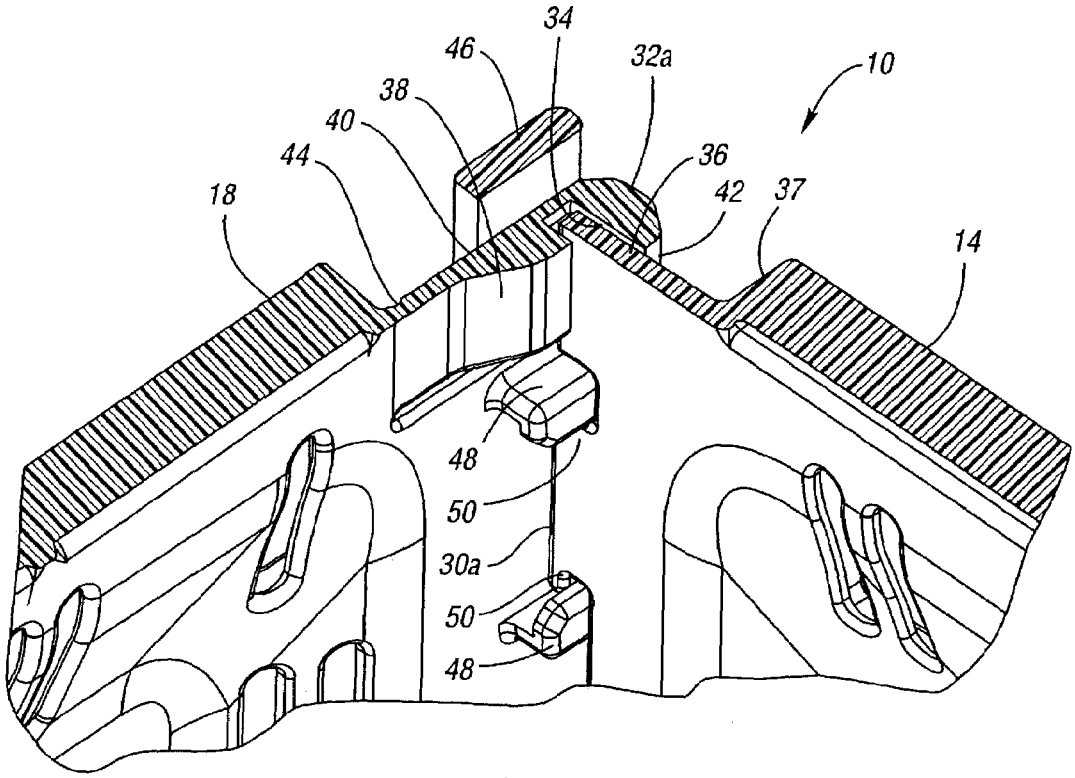
FIG. 2 is an enlarged perspective interior view of one corner of the collapsible crate of FIG. 1, with the top of the crate broken away.

FIG. 2 is an enlarged perspective view of the interior of corner 30*a*, with the top of the crate 10 cut away. The latch 32*a* is integrally molded with the end wall 18, which is preferably molded of polypropylene via an injection molding process but of course can be formed of any type of plastic applicable for the desired use. As can be seen in FIG. 2, the latch 32*a* includes a recess 34 into which a narrow portion 36 of reduced thickness of the side wall 14 is received to attach side wall 14 to latch 32*a* and end wall 18.

The narrow portion 36 of the side wall 14 forms a recess 37 on the outside of the side wall 14. The latch 32*a* includes an inner release surface 38, which is generally an inclined plane on a portion 40 tapering inwardly into the crate 10. In the assembled position, the inner release surface 38 is positioned inward of recess 34 and side wall 14. Latch 32*a* further includes outer release surface 42, positioned outward of the recess 34 in latch 32*a* and outward of the narrow portion 36 of the side wall 14. The outer release surface 42 is generally positioned within the recess 37 of the side wall 14, such that the outer release surface 42 can be accessed and actuated through the recess 37. An inner end of the latch 32*a* includes a slightly narrowed portion 44, which increases the flexibility of the latch 32*a* and permits the latch 32*a* to pivot and flex at narrowed portion 44.

The end wall 18 includes an integrally molded post 46 positioned outwardly of latch 32*a* for preventing excessive outward deflection of the latch 32*a*. The end wall 18 includes locking tabs 48 which interlock with locking tabs 50 on side wall 14 to increase the stability of the connection between the side wall 14 and end wall 18 at corner 30 as well as enhance alignment.

Figure 3:
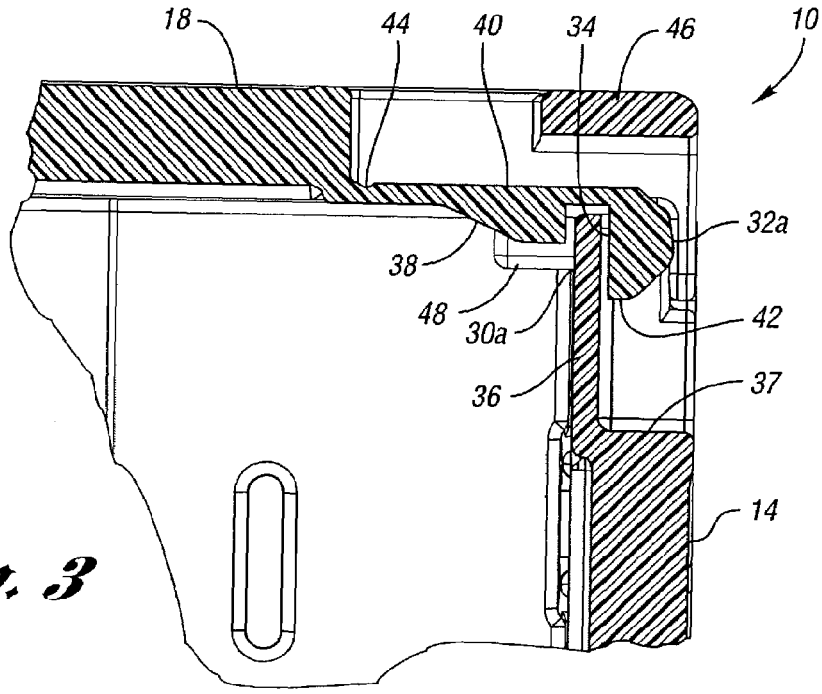
FIG. 3 is a top view of the portion of the collapsible crate of FIG. 2.

FIG. 3 is a top view of the portion of the crate 10 shown in FIG. 2, again with the top of the crate cut away. In FIGS. 2 and 3, the side wall 14 is latched to end wall 18 by the latch 32*a*. The portion 36 of the side wall 14 is securely received in the recess 34 of the latch 32*a*. In this manner, the side wall 14 and end wall 18 are maintained in a generally perpendicular use position. The outer release surface 42, and in the embodiment shown is completely contained within the recess 37 and does not protrude out from side wall 14. However, it is contemplated that the latch may protrude without departing from the teachings of the invention.

Figure 4:
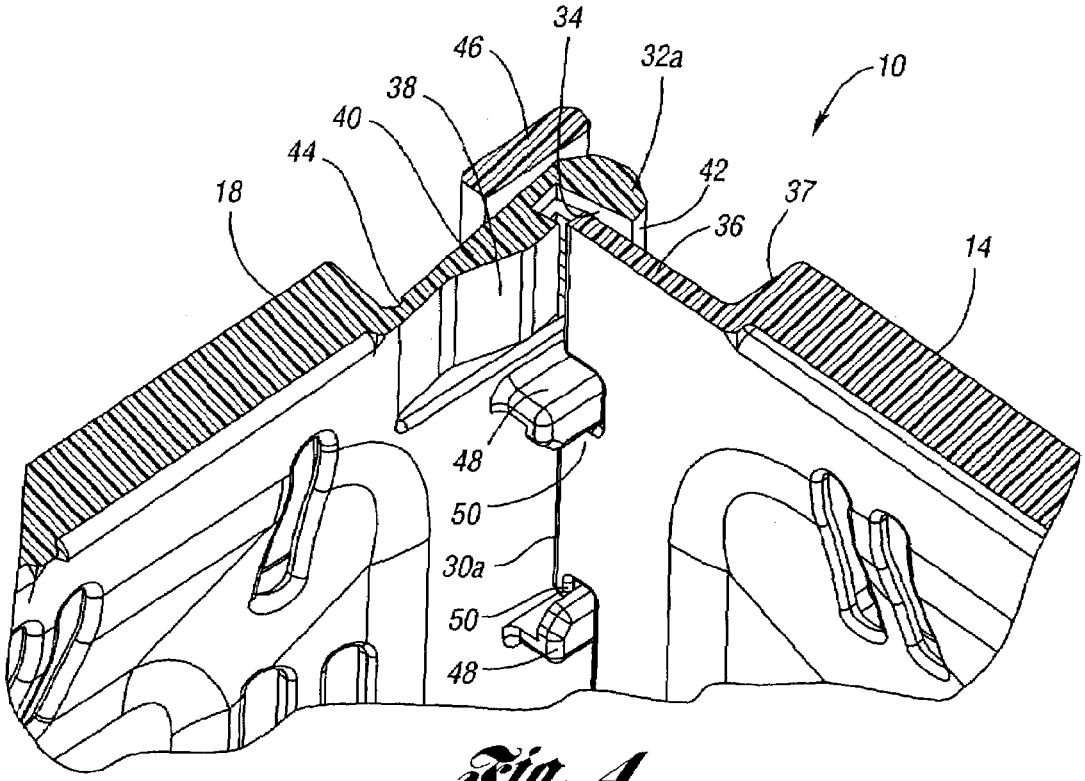
FIG. 4 is a perspective view of the portion of the collapsible crate of FIG. 2 with the latch in the unlatched position.

Referring to FIG. 4, when it is desired to return the crate 10 to the collapsed position, the latch 32*a* is biased and flexed outward toward the post 46 by the application of force on either the outer release surface 42 or the inner release surface 38. This causes the latch 32*a* to flex and pivot at the narrowed portion 44 and releases the portion 36 of the side wall 14 from the recess 34 of the latch 32*a*. The provision of the outer release surface 42 permits the actuation of the latch 32*a* from outside the crate 10, which is easier for a user of the crate. A crate 10 of the present invention also provides an inner release surface 38 which facilitates operation by automated equipment. The side wall 14 is then permitted to be pivoted downward to the collapsed position (after similarly actuating the latch 32*d* at the opposite end of side wall 14—FIG. 1). The opposite side wall is unlatched in a similar fashion and pivoted to the collapsed position, followed by the end walls 18 and 20 (FIG. 1).

Referring to FIG. 5, for assembly of the crate 10 to the use position, the end wall 18 is pivoted to the use position, generally perpendicular to the base 12 (not shown in FIG. 5). The side wall 14 is then pivoted upward, causing narrowed portion 36 of side wall 14 to contact the inner release surface 38, which causes latch 32 to flex outward at narrowed portion 44. When the narrowed portion 36 of the side wall 14 passes the inner release surface 38, the latch 32*a* snaps back toward the side wall 14 with the narrowed portion 36 received in recess 34 of the latch 32*a*, thus returning the crate to the condition originally shown in FIG. 2.

Figure 6:
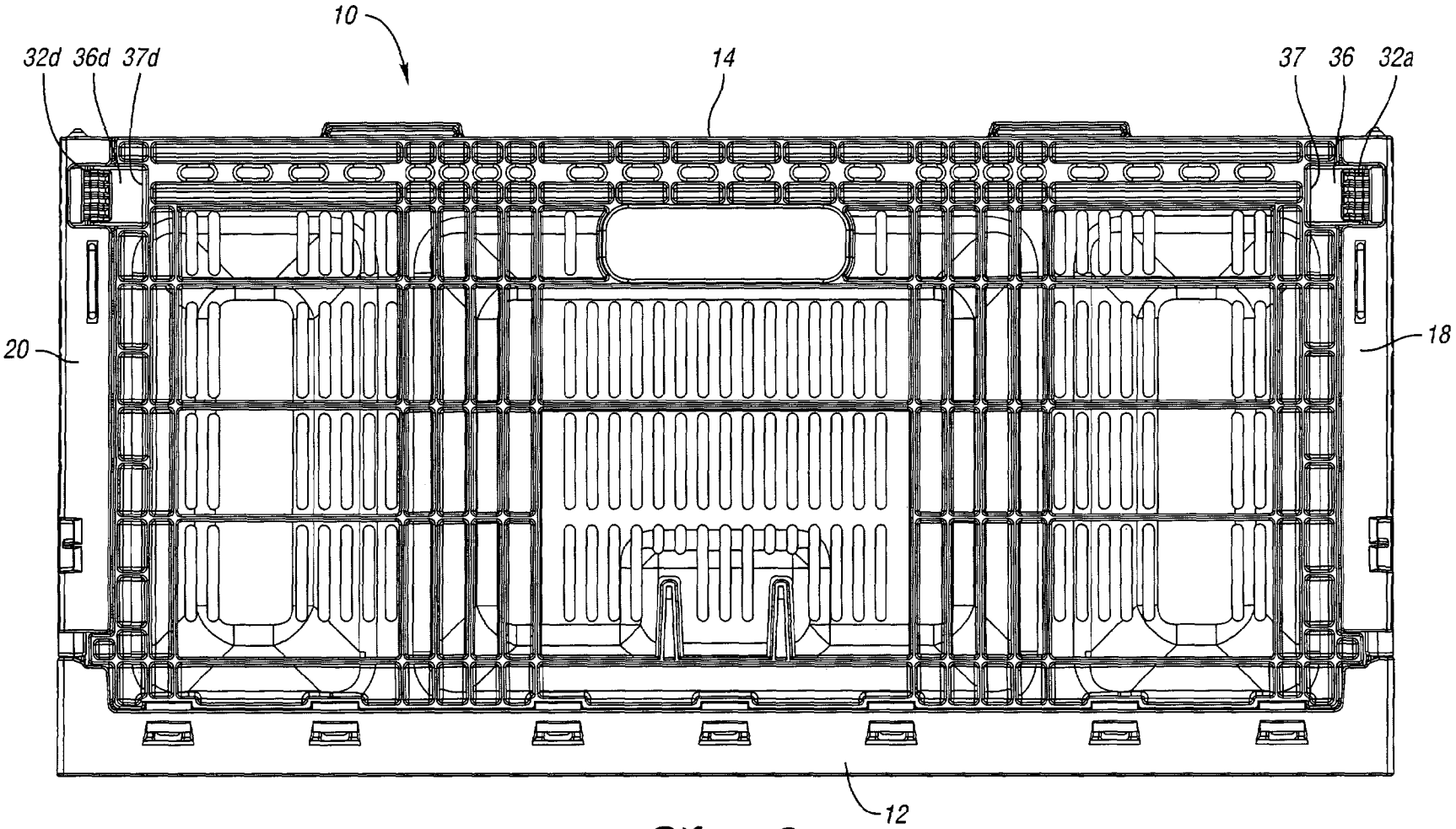
FIG. 6 is a side view of the collapsible crate of FIG. 1.

FIG. 6 illustrates a side view of the side wall 14. In FIG. 6, the first latch 32*a* is shown latched on the narrowed portion 36 of the side wall 14 and within the recess 37 formed inside wall 14. Similarly, latch 32*d* on end wall 20 is shown latched on narrowed portion 36*d* and within the recess 37*d*.

Figure 7:
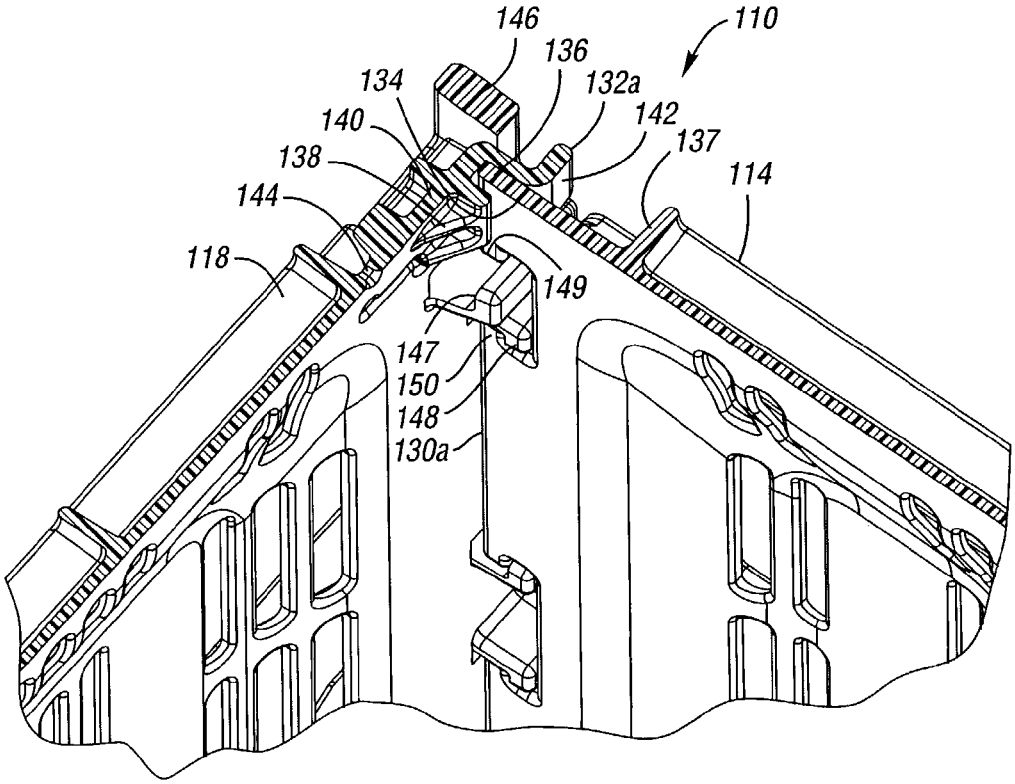
FIG. 7 is an enlarged perspective interior view of one corner of a collapsible crate similar to that shown in FIG. 1 (with the top of the crate broken away) with a second embodiment of the improved latches.

FIG. 7 shows a second crate 110 similar to that shown in FIGS. 1–6 but with a second embodiment of the improved latches 132 (latch 132*a* shown in FIG. 7). FIG. 7 is an enlarged perspective view of the interior of corner 132*a*, with the top of the crate 110 cut away. The latch 132*a* is integrally molded with the end wall 118, which is preferably molded of polypropylene via an injection molding process but of course can be formed of any type of plastic applicable for the desired use. As can be seen in FIG. 7, the latch 132*a* includes a recess 134 into which a narrow portion 136 of reduced thickness of the side wall 114 is received to attach side wall 114 to latch 132*a* and end wall 118.

The narrow portion 136 of the side wall 114 forms a recess 137 on the outside of the side wall 114. The latch 132*a* includes an inner release surface 138 which is generally an inclined plane on a portion 140 tapering inwardly into the crate 110. In the assembled position, the inner release surface 138 is positioned inward of recess 134 and side wall 114. Latch 132*a* further includes an outer release surface 142, positioned outward of the recess 134 in latch 132*a* and outward of the narrow portion 136 of the side wall 114. The outer release surface 142 is generally positioned within the recess 137 of the side wall 114, such that the outer release surface 142 can be accessed through the recess 137. An inner end of the latch 132*a* includes a slightly narrowed portion 144, which increases the flexibility of the latch 132*a* and permits the latch 132*a* to pivot and flex at narrowed portion 144.

The end wall 118 includes an integrally molded post 146 positioned outwardly of latch 132*a* for preventing excessive outward deflection of the latch 132*a*. The end wall 118 includes locking tabs, 147 and 148 which interlock with locking tabs 149 and 150 on side wall 114 to increase the stability of the connection between the side wall 114 and end wall 118 at corner 130*a* as well as enhance alignment.

Figure 8:
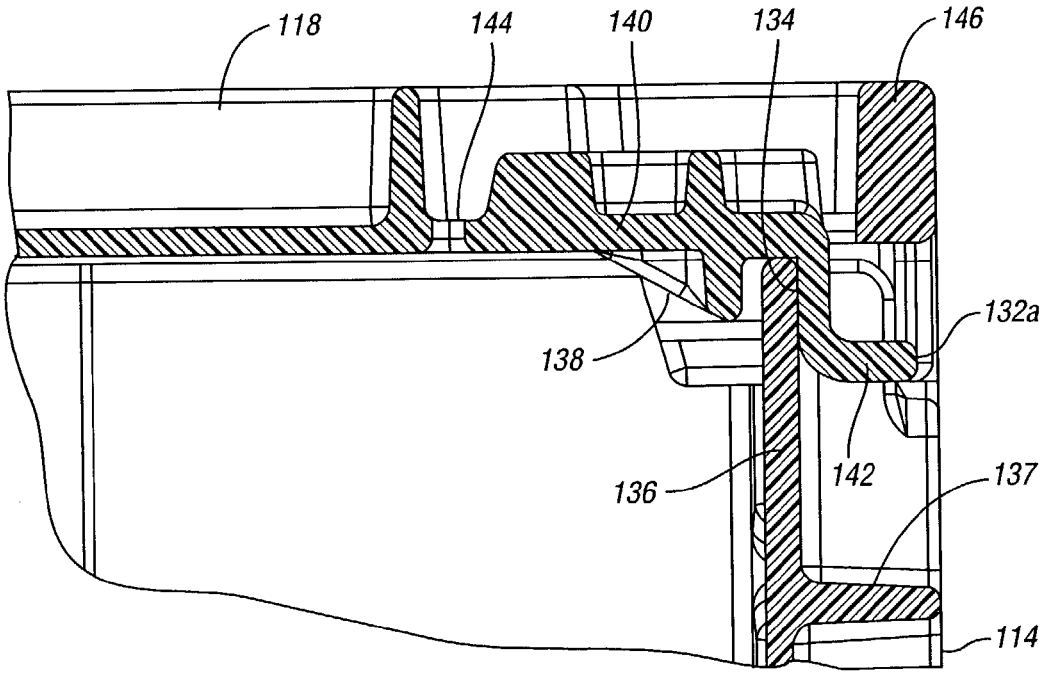
FIG. 8 is a top view of the portion of the collapsible crate of FIG. 7, with the top broken away.

FIG. 8 is a top view of the portion of the crate 110 shown in FIG. 7, again with the top of the crate 110 cut away. In FIGS. 7 and 8, the side wall 114 is latched to end wall 118 by the latch 132*a*. The portion 136 of the side wall 114 is securely received in the recess 134 of the latch 132*a*. In this manner, the side wall 114 and end wall 118 are maintained in a generally perpendicular use position. In the embodiment shown, the outer release surface 142 is completely contained within the recess 137 and does not protrude out from side wall 114.

Figure 9:
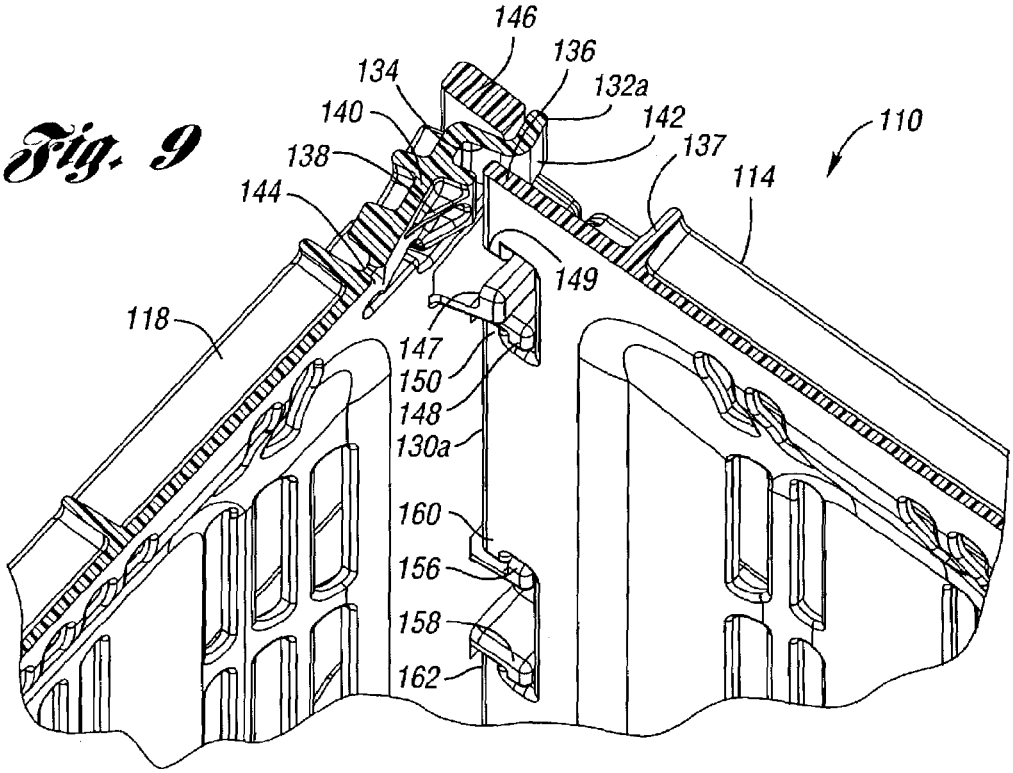
FIG. 9 is a perspective view of the portion of the collapsible crate of FIG. 8 with the latch in the unlatched position.

Referring to FIG. 9, when it is desired to return the crate 110 to the collapsed position, the latch 132*a* is biased and flexed outward toward the post 146 by the application of force on either the outer release surface 142 or the inner release surface 138. This causes the latch 132*a* to flex and pivot at the narrowed portion 144 and releases the portion 136 of the side wall 114 from the recess 134 of the latch 132*a*. The provision of the outer release surface 142 permits the actuation of the latch 132*a* from outside the crate 110, which is easier for a user of the crate. The crate 110 of the present invention also provides an inner release surface 138 which facilitates operation by automated equipment. The side wall 114 is then permitted to be pivoted downward to the collapsed position (after similarly actuating the latch at the opposite end of side wall 114). The opposite side wall is unlatched in a similar fashion and pivoted to the collapsed position, followed by the end walls 118 and 120. As can be seen in FIG. 9, the end wall 118 also includes a second pair of tabs 156, 158 which interlock with complementary tabs 160, 162 on side wall 114 prior to the latch 132*a* flexing outward as the side wall 114 is erected.

Figure 10:
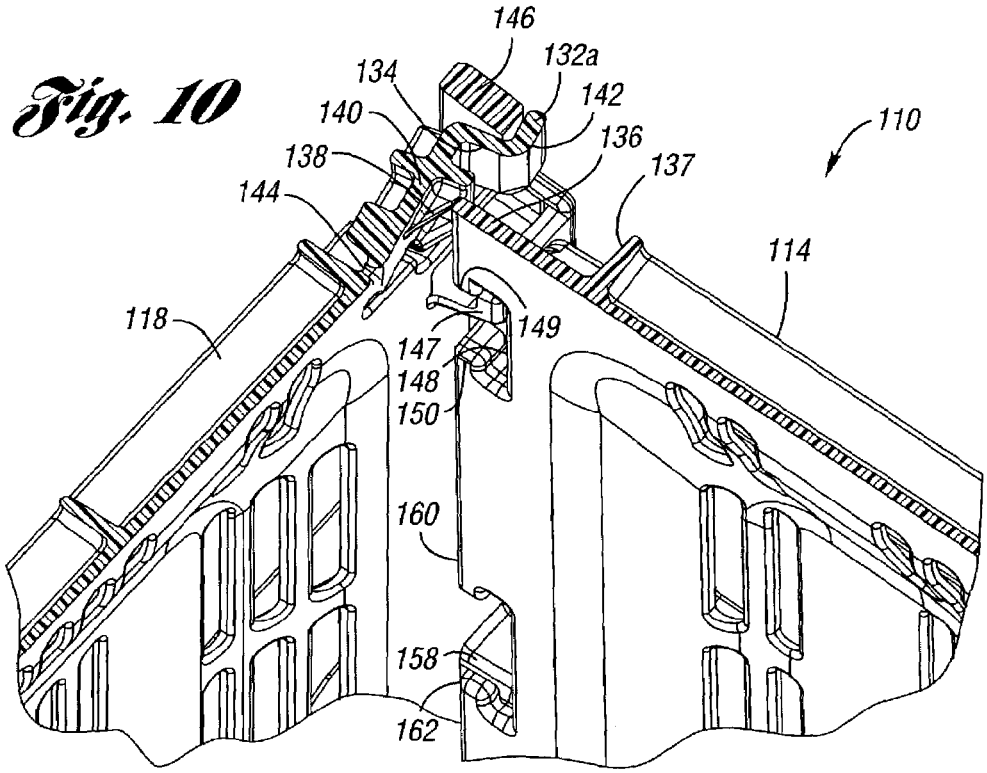
FIG. 10 is a second view, similar to FIG. 9, of the latch in the unlatched position, and wall partially collapsed.

Referring to FIG. 10, for assembly of the crate 110 to the use position, the end wall 118 is pivoted to the use position, generally perpendicular to the base 112 (not shown in FIG. 10). The side wall 114 is then pivoted upward, causing narrowed portion 136 of side wall 114 to contact the inner release surface 138, which causes latch 132 to flex outward at narrowed portion 144. When the narrowed portion 136 of the side wall 114 passes the inner release surface 138, the latch 132*a* snaps back toward the side wall 114 with the narrowed portion 136 received in recess 134 of the latch 132*a*, thus returning the crate to the condition originally shown in FIG. 7.

Figure 11:
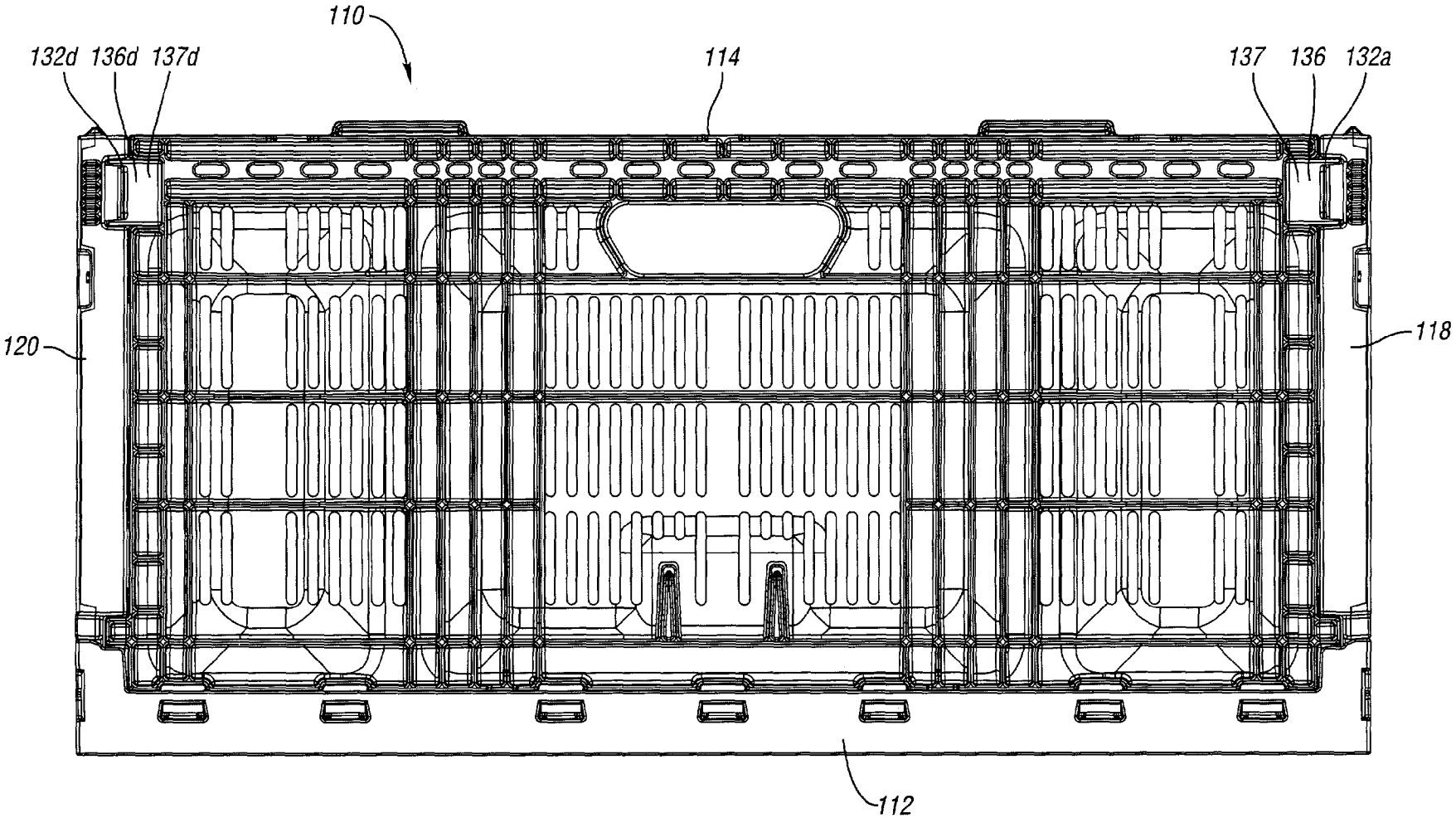
FIG. 11 is a side view of the collapsible crate of FIG. 7.

FIG. 11 illustrates a side view of the side wall 114. In FIG. 11, the first latch 132*a* is shown latched on the narrowed portion 136 of the side wall 114 and within the recess 137 formed inside wall 114. Similarly, latch 132*d* on end wall 120 is shown latched on narrowed portion 136*d* and within the recess 137*d*.

Figure 12:
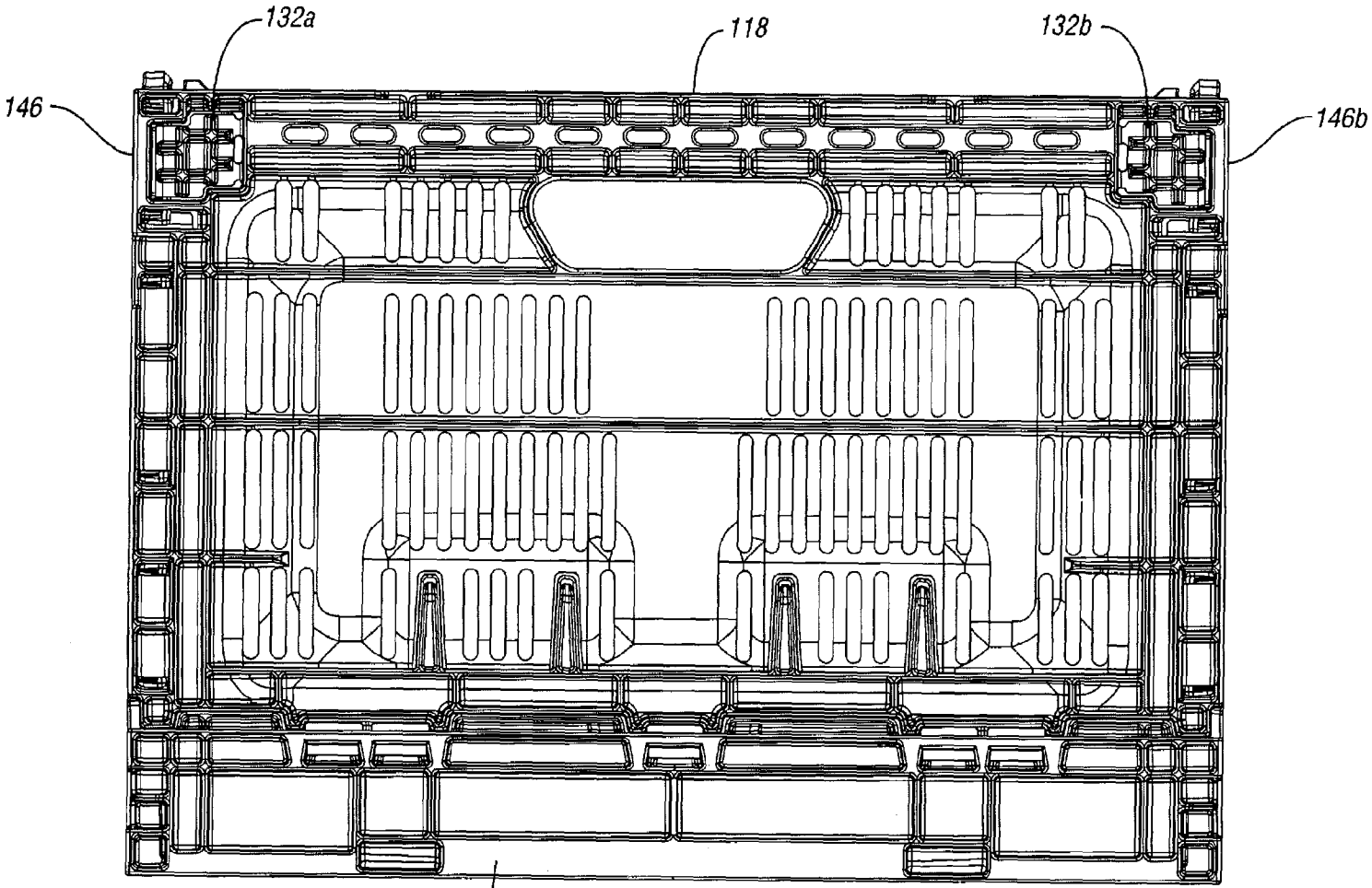
FIG. 12 is an end view of the collapsible crate of FIG. 7.

FIG. 12 illustrates an end view of end wall 118. The latch 132*a* can be observed adjacent the post 146. Similarly, the latch 132*b* is visible adjacent post 146*b*.

Figure 13:
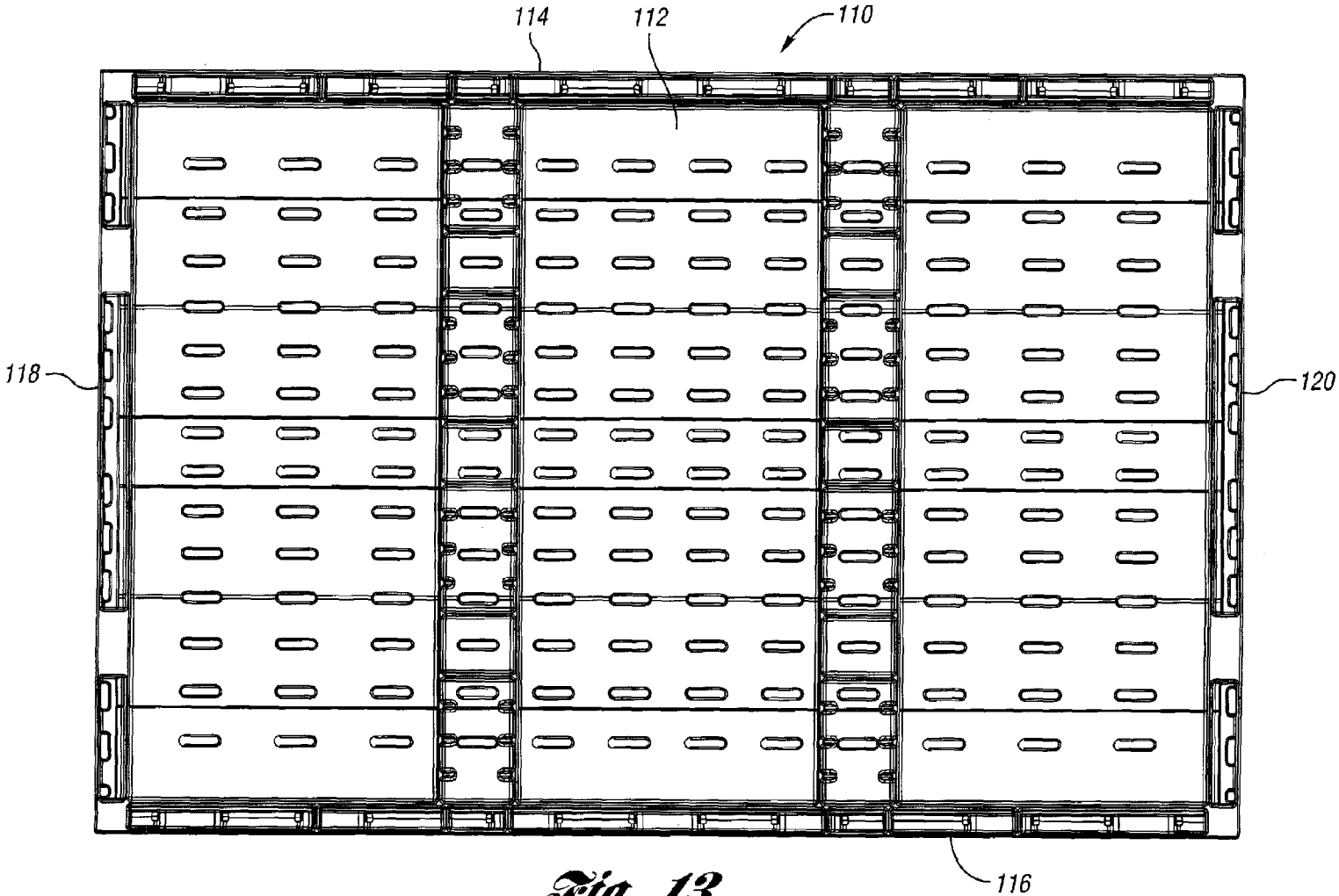
FIG. 13 is a bottom view of the collapsible crate of FIG. 7.

FIG. 13 illustrates a top view of crate 110.

Figure 14:
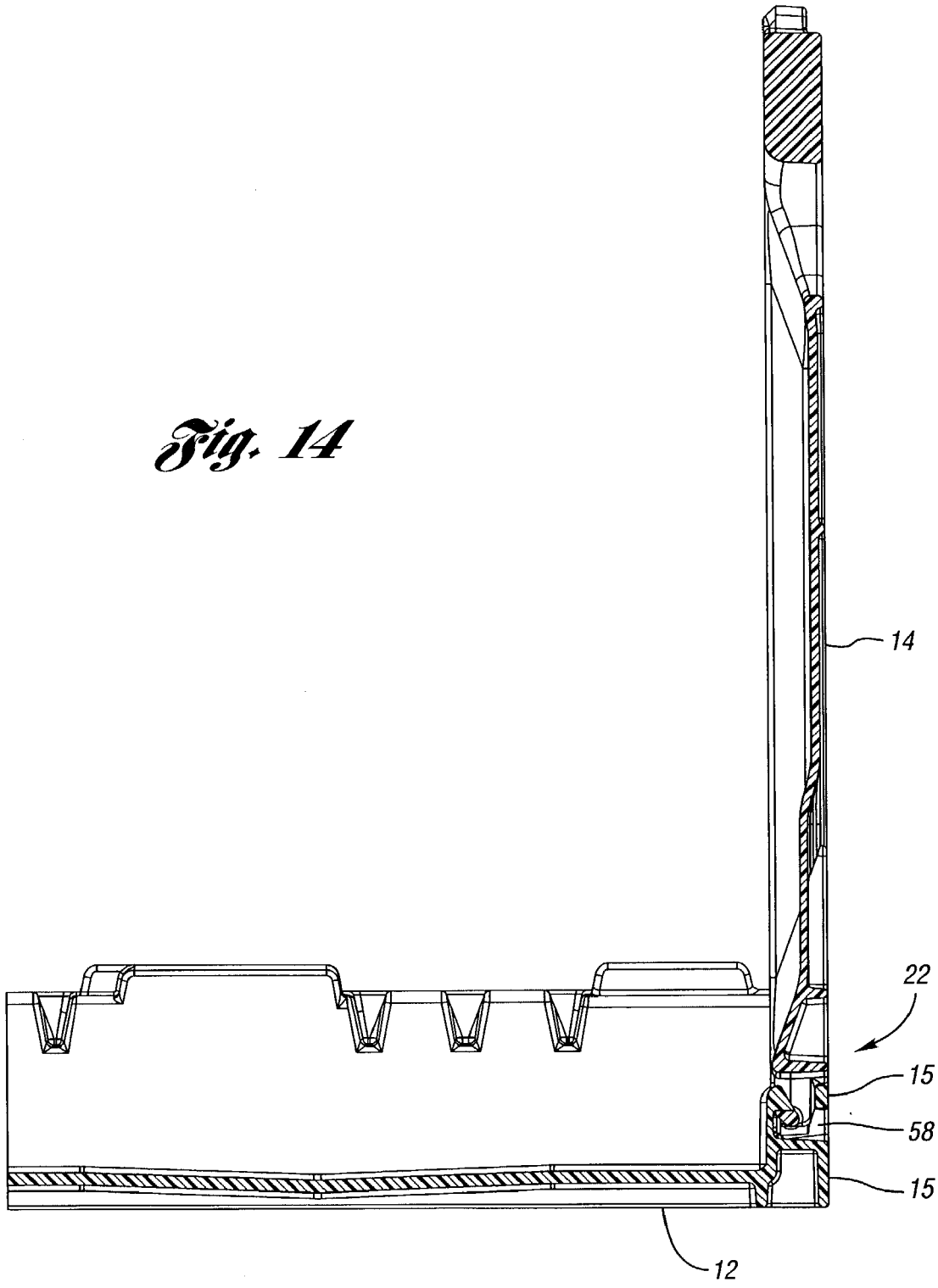
FIG. 14 is a cross-sectional elevational view of the device according to the present invention, taken along the sidewall centerline of the container, through a hinge mechanism.
Figure 15:
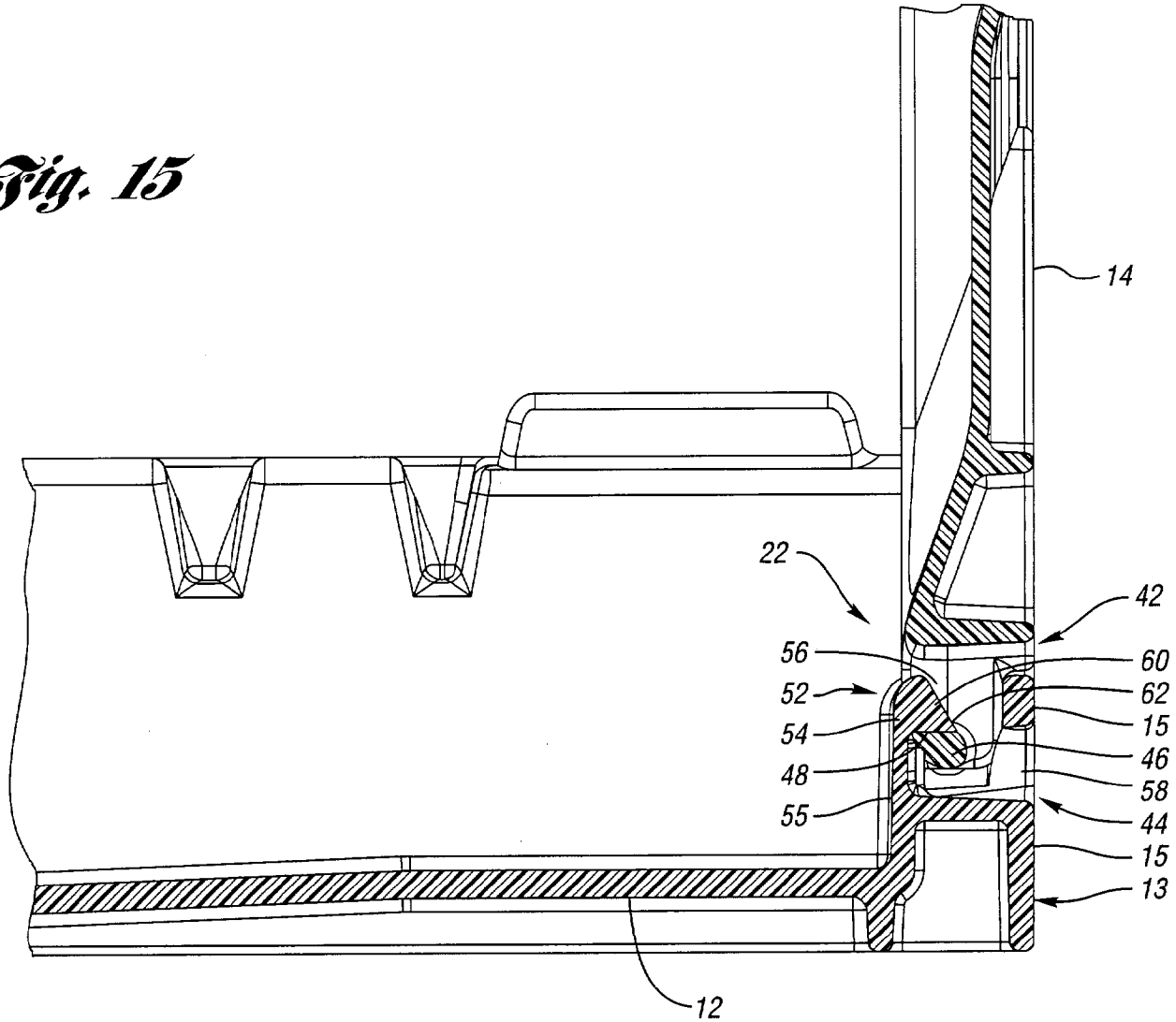
FIG. 15 is a magnified view of FIG. 14, showing the hinge mechanism.

As shown in FIGS. 14 and 15, crates 10, 110 also include a plurality of hinge mechanisms 22 extending therearound. Each hinge mechanism 22 includes an upper hinge portion 42, and a lower hinge portion 44. Upper hinge portion 42 is formed with the sidewalls and is shown as a bar member 46 having a cam cross-section which includes a flat surface 48. Lower hinge portion 44 is formed along the edge of the base 12 and includes a hinge receiving area 52, having a flexible member 54 defining an inner base wall surface 55. Hinge receiving area 52 also has a top opening 56 and a base side opening 58. Side wall 14 is pivotably attached to the base member 12 by the upper and lower hinge portions 42 and 44 cooperating with each other.

Upon assembly, when the wall is in the inwardly folded position, bar member 46 is inserted in the top opening 56, causing flexible member 54 to slightly deflect temporarily, until bar member 46 is disposed below a projection 60 of flexible member 54, whereupon flexible member 54 returns to its rest position. Thus, projection 60 has a lower surface 62 that cooperates with surface 48, and thus serves as a stop mechanism so sidewall 14 does not release from base 12. Thus, the upper hinge portion cooperates with the lower hinge portion for providing the pivotable attachment therebetween. As illustrated, base member 12 has an upstanding base wall 13 having an outer surface 15. Side opening 58 extends from the upstanding base wall outer surface 15 to the cooperating portion of hinge mechanism 22, thereby providing for a more shallow draw during molding, improving cooling efficiencies, as well as enhancing the washing process of the hinge mechanism 22 by allowing cleaning fluids to enter opening 58 and travel a relatively shorter distance to the hinge mechanism. Some containers of the prior art may include a longer draw extending from the bottom surface of the container as part of a shutoff, which extends the draw and reduces cooling efficiencies.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for collapsible crates and many variations in design, many of which would benefit from the present invention. All are considered to be within the scope of the present invention. For example, the side walls 14, 16, 114, 116 and end walls 18, 20, 118, 120 could pivot outward to the collapsed position, rather than inward onto the base 12,112. The latches 32,132 could be on the end walls instead of the side walls. Modifications to the latches 32, 132 for different applications are also possible, while still retaining the benefits of the present invention. The latches 32, 132 could be formed separately and subsequently attached to the crate 10, 110. Alphanumeric identifiers for steps in method claims are for ease of reference in dependent claims and do not signify a required sequence unless otherwise stated.

What is claimed is:

1. A container comprising:

a base wall;

a first wall generally perpendicular to the base wall;

a second wall generally perpendicular to the base wall and the first wall; and a latch integrally molded with the first wall for selectively connecting the first wall to the second wall, wherein the latch flexes relative to the first wall upon the pivoting of the second wall to an upright position in order to connect the first wall to the second wall, the latch including an outer release surface outward of the second wall, the latch including an inner release surface inward of the second wall and inward of an outer surface of the first wall, the latch configured to flex relative to the first wall to selectively disconnect the latch from the second wall upon an application of force to the outer release surface and the latch configured to flex relative to the first wall to selectively disconnect the latch from the second wall upon an application of force to the inner release surface.

2. The crate of claim 1 wherein the latch includes a recess into which a portion of the second wall is received when the latch is connected to the second wall.

3. The crate of claim 2 wherein the latch is tapered away from the recess.

4. The crate of claim 2 wherein the latch is flexible away from the second wall in order to disconnect the second wall from the latch.

5. The crate of claim 4 wherein the outer release surface is positioned outward of the recess and the inner release surface is positioned inward of the recess.

6. The crate of claim 5 wherein the second wall includes a portion of reduced thickness received within the recess.

7. The collapsible container of claim 1 wherein the inner release surface is more inward of the container than an innermost surface of the first wall.

8. The container of claim 1 further including a first interlocking member on the first wall interlocking with a second interlocking member on the second wall, the first and second interlocking members preventing pivoting movement of the first wall away from the second wall.

9. A container comprising:

a base wall;

a first wall generally perpendicular to the base wall;

a second wall generally perpendicular to the base wall and the first wall; and a latch integrally molded with the first wall for selectively connecting the first wall to the second wall, the latch including a recess into which a portion of the second wall is received when the latch is connected to the second wall, the latch being flexible away from the second wall in order to disconnect the second wall from the latch, the latch including an outer release surface outward of the second wall and outward of the recess, the latch including an inner release surface inward of the second wall, inward of the recess and inward of an outer surface of the first wall, the latch configured to flex relative to the first wall to selectively disconnect the latch from the second wall upon an application of force to the outer release surface and the larch configured to flex relative to the first wall to selectively disconnect the latch from the second wall upon an application of force to the inner release surface, wherein the second wall includes a portion of reduced thickness received within the recess, and the second wall includes a recess on an outer surface of the second wall at the portion of reduced thickness, the outer release surface accessible within the recess on the outer surface of the second wall.

10. The crate of claim 9 wherein the first and second walls are connected by hinges to the base wall and selectively movable between a collapsed position generally parallel to the base wall and a use position generally perpendicular to the base wall.

11. The crate of claim 10 wherein the first and second walls include interlocking tabs.

12. A container comprising:

a base wall;

a first wall generally perpendicular to the base wall;

a second wall generally perpendicular to the base wall and the first wall; and a latch integrally molded with the first wall far selectively connecting the first wall to the second wall, the latch including an outer release surface outward of the second wall and an inner release surface inward of the second wall, the latch configured to selectively disconnect the latch from the second wall upon an application of force to the outer release surface and the latch configured to selectively disconnect the latch from the second wall upon an application of force to the inner release surface, and wherein one of the first wall and second wall includes a post positioned outwardly of latch for preventing excessive outward deflection of the latch.

13. A collapsible crate comprising:

a base wall;

a first wall movable about a first hinge between a collapsed position generally parallel to the base wall and a use position generally perpendicular to the base wall;

a second wall movable about a second hinge between a collapsed position generally parallel to the base wall and a use position generally perpendicular to the base wall; and a latch integrally molded with the first wall for selectively connecting the first wall to the second wall while the first and second walls are in the use position, wherein the latch includes a outer release surface outward of the second wall and an inner release surface inward of the second wall, the latch configured to be selectively disconnected from the second wall upon the application of force from the inside of the container to the inner release surface and configured to be selectively disconnected from the second wall upon the application of force from the outside of the container to the outer release surface, wherein the latch is latched based upon the movement of one of the first wall and the second wall from the collapsed position to the use position, thereby causing the latch to flex relative to the first wall which then moves into a latched position thereby connecting the first wall to the second wall.

14. The collapsible crate of claim 13 wherein the latch includes a recess into which a portion of the second wall fits when the latch is connected to the second wall.

15. The collapsible crate of claim 14 wherein the outer release surface is positioned outward of the recess and the inner release surface is positioned inward of the recess.

16. A collapsible crate orientable between a collapsed position and an assembled position comprising:

a base;

a first pair of opposed side walls pivotably connected to the base and each having a latch member with an inner release surface and an outer release surface;

a second side wall pivotably connected to the base, wherein when in the assembled position, the first pair of opposed side walls are attached to the second side wall by the latch members receiving a portion of the second side wall therein, wherein to return the crate from the assembled position to the collapsed position the latch members are configured to be selectively unlatched by application of forces in directions away from one another to the inner release surfaces disposed inward of the second wall and to the outer release surfaces disposed outward of the second wall.

17. The collapsible crate of claim 16 wherein each of the first side walls includes at least two of the latch members.

18. The collapsible crate of claim 16 wherein the latch members are configured to be selectively actuated upon an application of an outward force to the inner release surface and upon an application of an outward force to the outer release surface.

19. The collapsible crate of claim 16 further including a post positioned outwardly of each latch for preventing excessive outward deflection of the latch.

20. A container comprising:

a base wall;

a first wall generally perpendicular to the base wall;

a second wall generally perpendicular to the base wall and the first wall; and a latch integrally molded with the first wall for selectively connecting the first wall to the second wall, the latch including an outer release surface outward of the second wall, the latch including an inner release surface inward of the second wall and inward of an outer surface of the first wall, the latch configured to flex relative to the first wall to selectively disconnect the latch from the second wall upon the application of force in a direction outward of the interior of the container to the inner release surface and the latch configured to flex relative to the first wall to selectively disconnect the latch from the second wall upon the application of force in a direction outward of the interior of the container to the outer release surface.

21. The collapsible container of claim 20 wherein the latch flexes relative to the first wall upon the pivoting of the second wall to an upright position in order to connect the first wall to the second wall.

22. A container comprising:

a base wall;

a first wall generally perpendicular to the base wall;

a second wall generally perpendicular to the base wall and the first wall;

a first interlocking member on the first wall interlocking with a second interlocking member on the second wall the first and second interlocking members preventing pivoting movement of the first wall away front the second wall; and a latch integrally molded with the first wall for selectively connecting the first wall to the second wall, wherein the first and second interlocking members are a distance from the base different from that of the latch, the latch including an outer release surface outward of the second wall, the latch including an inner release surface inward of the second wall and inward of an outer surface of the first wall, the latch configured to flex relative to the first wall to selectively disconnect the latch from the second wall upon an application of force to the outer release surface and the latch configured to flex relative to the first wall to selectively disconnect the latch from the second wall upon an application of force to the inner release surface.

* * * * *

UNITED STATES PATENT AND TRADEMARK OFFICE

CERTIFICATE OF CORRECTION

PATENT NO. : 7,059,489 B2
APPLICATION NO. : 10/269546
DATED : June 13, 2006
INVENTOR(S) : Apps et al.

It is certified that error appears in the above-identified patent and that said Letters Patent is hereby corrected as shown below:

Claim 2, Column 6, Line 22 of the issued patent, “crate” should read as --container--.

Claim 3, Column 6, Line 25 of the issued patent, “crate” should read as --container--.

Claim 4, Column 6, Line 27 of the issued patent, “crate” should read as --container--.

Claim 5, Column 6, Line 30 of the issued patent, “crate” should read as --container--.

Claim 6, Column 6, Line 33 of the issued patent, “crate” should read as --container--.

Claim 7, Column 6, Line 35 of the issued patent, delete “collapsible”.

Claim 13, Column 7, Line 45 of the issued patent, “container” should read as --crate--.

Claim 13, Column 7, Line 48 of the issued patent, “container” should read as --crate--.

Signed and Sealed this

Eighteenth Day of March, 2008

JON W. DUDAS
*Director of the United States Patent and Trademark Office*